United States Patent [19]

Greenwood

[11] 4,207,781

[45] Jun. 17, 1980

[54] CONTAINER OPENING DEVICE

[76] Inventor: Philip R. Greenwood, 825 Lorain St., Toledo, Ohio 43607

[21] Appl. No.: 936,110

[22] Filed: Aug. 23, 1978

[51] Int. Cl.[2] ..... B67B 7/00

[52] U.S. Cl. ..... 81/3.46 R

[58] Field of Search ..... 7/110, 151, 169; 81/3.46 R, 3.46 A

[56] References Cited

U.S. PATENT DOCUMENTS

| | | | |
|---|---|---|---|
| 3,656,375 | 4/1972 | Reed et al. | 81/3.46 R |
| 3,736,643 | 6/1973 | Pene | 81/3.46 R X |

FOREIGN PATENT DOCUMENTS

| | | | |
|---|---|---|---|
| 421574 | 12/1934 | United Kingdom | 81/3.46 A |

*Primary Examiner*—James G. Smith

*Attorney, Agent, or Firm*—Wilson, Fraser, Barker & Clemens

[57] ABSTRACT

A device for opening a container having a ring-type opening tab secured to a removable section defined by a score line in one end panel of the container. The device comprises a main body portion provided with a generally curved surface for engagement with the one end panel and further having a handle extending in one direction from the main body portion and a projection extending in an opposite direction from the main body portion. In operation, the user grips the handle, inserts the projection into the tab, and wedges the projection between the tab and the one end panel of the container. A downward force is then applied to the handle such that the opening tab is lifted to remove the removable section.

4 Claims, 4 Drawing Figures

CONTAINER OPENING DEVICE

BACKGROUND OF THE INVENTION

One development in the container industry which has gained wide acceptance with consumers is the "self-opening" container which can be opened by means of an opening tab secured to one end panel of the container. One form of such a container is the beer and beverage container in which the product is dispensed through an aperture which is opened when the opening tab is lifted to tear away and remove a removable section defined by a score line in the one end panel of the container.

One problem associated with this type of container is readily apparent to those whose occupations require them to continuously open these types of containers, for example, bartenders, waitresses, etc. This is the problem of undue stress and strain which are inflicted on the fingers and associated fingernails of one who for extended periods inserts their finger into the opening tab of a container and must pull the opening tab to tear away the removable section.

Another problem associated with this type of container is that, unless the opening tab is pulled in such a manner as to cause the upward force to be evenly distributed between the two points at the ends of the unfractured score line, there is a possibility that a fracture may develop into the interior of the removable section. This causes only a portion of the removable section to be removed along with the opening tab, while leaving the other portion attached to the end panel of the container. This creates an inconvenience to the one opening the container as it is usually necessary to obtain a tool to remove the remaining portion of the removable section.

SUMMARY OF THE INVENTION

It is an object of the present invention to produce a device for opening containers having a ring-type opening tab which substantially reduces the stress and strain inflicted on the users' finger.

Another object of the invention is to produce a device for opening containers having a ring-type opening tab which evenly distributes the upward force between the two points at the ends of the unfractured score line to effectively result in the removal of the entire removable section.

The above and other objects of the invention may be achieved by a device for opening a container having a ring-type opening tab attached to a removable section located on one end of the container, wherein the device comprises a main body portion having a generally curved surface for engagement with the one end panel of the container: a handle extending in one direction from the main body portion; and a projection extending in an opposite direction from the main body portion for engaging the opening tab of the panel of the container. The device may include a slot formed in the main body portion for receiving a portion of the peripheral end flange of the can.

BRIEF DESCRIPTION OF THE DRAWINGS

The objects and advantages of the invention will become readily apparent to one skilled in the art from reading the following detailed description of an embodiment of the invention when considered in connection with the accompanying drawings in which.

DETAILED DESCRIPTION OF THE PREFERRED EMBODIMENT OF THE INVENTION

Figure 1:
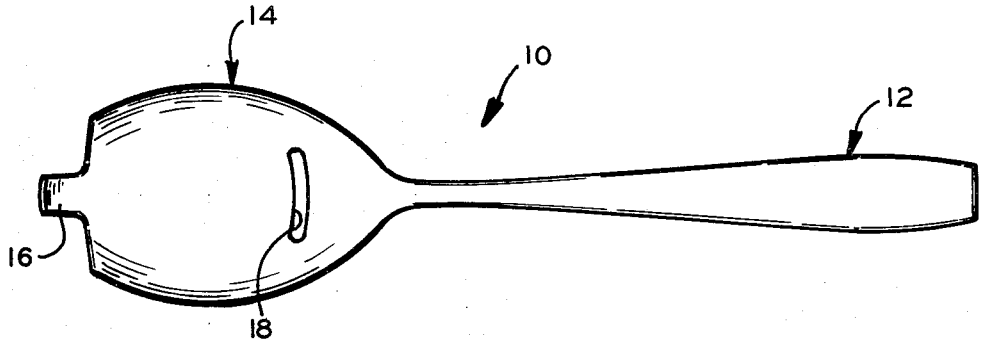
FIG. 1 is a top elevation view of a container opening device constructed in accordance with the present invention.
Figure 2:
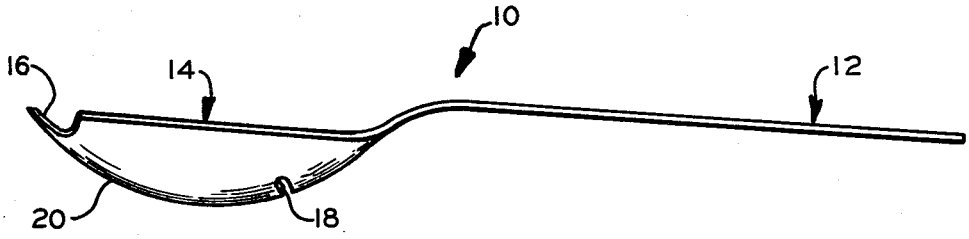
FIG. 2 is a side elevation view of the device illustrated in FIG. 1.

Referring to FIGS. 1 and 2, there is illustrated a device 10 incorporating the principle features of the present invention for opening a container having a ring-type opening tab. The device 10 comprises a handle portion 12 extending in one direction from a main body portion 14. A projection 16 extends in an opposite direction from the main body portion 14. An arcuate slot 18 is formed in the main body portion.

The handle 12, the main body portion 14 and the projection 16 one typically formed from a single sheet of metal using suitable forming dies. A corrosion-resistant material such as stainless steel has been found to exhibit many advantageous characteristics for use in fabricating the device of the invention.

As illustrated in FIG. 2, the main body portion 14 has a lower surface 20 which is curved for engagement with the top portion of an associated container end closure as will be discussed.

Figure 3:
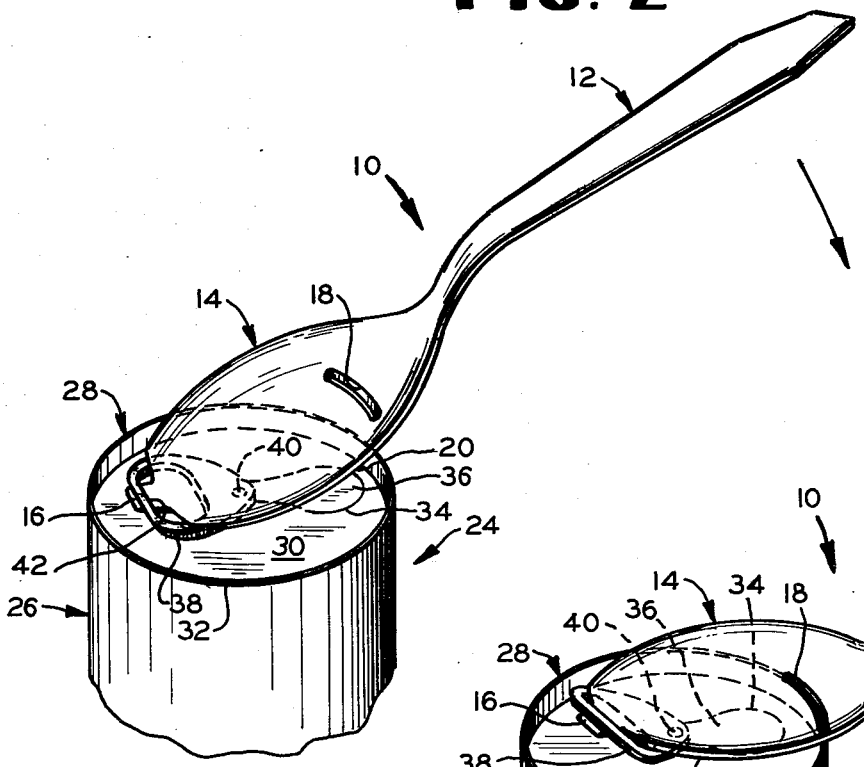
FIG. 3 is a fragmentary perspective view illustrating an initial step in the operation of the device illustrated in FIGS. 1 and 2.
Figure 4:
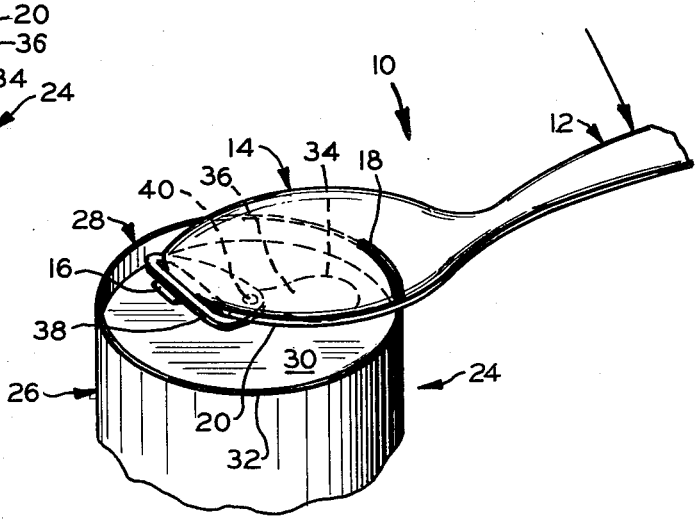
FIG. 4 is a fragmentary perspective view illustrating an intermediate step in the operation of the device illustrated in FIGS. 1 and 2.

FIGS. 3 and 4 illustrate the operation of the container opening device 10 wherein there is illustrated a metal container 24 of the type typically employed to contain a carbonated beverage. The container 24 includes a main body 26 and an end closure 28. The end closure 28 is provided with a flat central panel 30 and an edge-curled peripheral flange 32 sealingly attached to the top end portion of the main body 26 to form the completed container 24.

A score line 34 is formed in the central panel 30 to create a weakening line and define a removable section 36. A ring-type opening tab 38 is secured to one end of the removable section 36 by means of a rivet 40. The opening tab 38 has an opening 42 formed therein to assist one in the opening of the container by removing the removable section 36.

In the operation as illustrated in FIG. 3, the user grips the handle portion 12 and inserts the projection 16 into the opening 42 and wedges the projection 16 between the opening tab 38 and the flat portion 30 such that the longitudinal axes of the device 10 and the removable section 36 are in generally vertical alignment. A downward force is then exerted on the handle portion 12, such that the device 10 functions as a lever to lift the tab 38 away from the flat panel 30.

The fulcrum of the handle portion 12, the associated main body portion 14, and the projection 16 which cooperatively function as a lever is initially at a point on the surface 20 proximate the projection 16. As the handle 12 is moved downwardly, the fulcrum moves along the surface 20 away from the projection 16 until the arcuate slot 18 receives a portion of the peripheral flange 30, as shown in FIG. 4. Thereafter, the end portions of the slot 18 each engage the top of the flange 32 such that they function as a double fulcrum as the handle portion 12 is continued to be moved downwardly.

During the downward movement of the handle portion 12, the tab 38 is lifted to a point at which the rivet 40 and a portion of the removable section 36 are pulled away from the panel 30. This causes the portion of the score line 34 which is proximate the rivet 40 to rupture. Additional downward movement of the handle portion 12 causes further rupture of the score line 34, until the entire score line has been fractured, and the removable section 36 has been disengaged from the panel 30.

It should be noted that the slot 18 is effective to provide a means for steadying the device during the opening operation. The slot also provides a means for evenly distributing the upward force between the two points at the ends of the unfractured portion of the score such that the section 36 will be removed in its entirety.

In accordance with the provisions of the patent statutes, I have explained the principle and mode of operation of my invention and have illustrated and described what I now consider to represent the best embodiment. However, I desire to have it understood that within the scope of the appended claims, the invention may be practiced otherwise than as specifically illustrated and described.

What I claim is:

1. A device for opening a container having a ring-type opening tab which is attached to a removable section located on one end panel of the container wherein said device comprises:

a main body portion having a generally curved surface for engagement with the one end panel of the container;

a handle extending in one direction from said main body portion; and a projection extending in an opposite direction of said handle and extending from said main body portion for engaging the opening tab of the panel of the container.

2. The device defined in claim 1 wherein said main body portion has a slot for receiving a portion of a flange which extends around the periphery of the one end panel of the can.

3. The device defined in claim 2 wherein said slot is spaced from said projection.

4. The device defined in claim 1 wherein said handle, said main body portion and said projection are constructed of a corrosion-resistant metal.

* * * * *